United States Patent [19]

Keller

[11] Patent Number: 4,686,816

[45] Date of Patent: Aug. 18, 1987

[54] DIP TUBE LOADER AND HANDLER APPARATUS

[76] Inventor: Ernst Keller, 259 Leota Ave., Sunnyvale, Calif. 94086

[21] Appl. No.: 857,851

[22] Filed: Apr. 30, 1986

[51] Int. Cl.[4] ..... B65B 5/10

[52] U.S. Cl. ..... 53/536; 53/236; 53/245; 53/538

[58] Field of Search ..... 53/536, 538, 532, 254, 53/260, 245, 250, 249, 148, 236

[56] References Cited

U.S. PATENT DOCUMENTS

| | | | |
|---|---|---|---|
| 2,297,253 | 9/1942 | Scotti | 53/538 X |
| 3,170,559 | 2/1965 | Clements | 53/532 X |
| 3,609,939 | 10/1971 | Hooper et al. | 53/250 X |
| 4,104,846 | 8/1978 | Waller | 53/536 X |
| 4,138,835 | 2/1979 | Takayanagi et al. | 53/536 X |
| 4,235,066 | 11/1980 | King et al. | 53/532 X |

*Primary Examiner*—James F. Coan

*Attorney, Agent, or Firm*—Claude A. S. Hamrick

[57] ABSTRACT

A DIP tube loader and handler including magazine for containing a quantity of empty DIP packaging tubes, a tube singulating mechanism for positioning the tubes one at a time into a position to be loaded with DIPs, a DIP singulating mechanism for loading a predetermined number of DIPs into the tubes, and a tube elevator for transporting the loaded tubes from the loading position into a hopper.

16 Claims, 5 Drawing Figures

DIP TUBE LOADER AND HANDLER APPARATUS

BACKGROUND OF THE INVENTION

1. Field of the Invention

The present invention relates generally to apparatus for loading and handling the plastic, aluminum or other type of tubes into which dual in-line packaged (DIP) IC devices are typically loaded for shipment, and more particularly, to an improved loading and handling device having means for moving a loaded tube from a loading position into a hopper without subjecting the loaded tube to unacceptable shock conditions.

In the processing of dual in-line packaged semiconductor devices, means have in the past been provided for automatically positioning a DIP carrying tube at the end of a slide or chute to receive a quantity of DIPs and then be off-loaded. However, in such devices, after the tube is loaded, it is normally kicked out of the loading position and allowed to drop into a hopper. Since some types of DIPs are sensitive to shock, the use of such devices is not suitable because of the damage that is caused to the dips by the rapid acceleration and/or deceleration of the parts during the off loading operation.

SUMMARY OF THE PRESENT INVENTION

It is therefore a principal objective of the present invention to provide a novel DIP tube loader and handler device in which empty tubes are fed one at a time to a loading position, are loaded, and then discharged from the loading position into a hopper without subjecting the devices to the violent shock normally experienced in prior art apparatus.

Another objective of the present invention in to provide a device of the type described, in which means is provided for transporting a loaded dip tube from a loading position into a hopper.

Briefly, a preferred embodiment of the present invention includes a magazine for containing a quantity of empty DIP packaging tubes, a singulating mechanism for positioning the tubes one at a time into a position to be loaded with DIPs, and elevator means for transporting the loaded tubes from the loading position into a hopper.

An important advantage of the present invention is that it enables tubes to be loaded at a high rate without subjecting the carried DIPs to the shock normally experienced in prior art loader/handler apparatus.

Another important advantage of the present invention it accomplishes a gentle transport of loaded tubes from a loading position into a hopper.

These and other advantages of the present invention will no doubt become apparent to those skilled in the art after having read the following detailed description of a preferred embodiment which is illustrated in the several figures of the drawing.

IN THE DRAWING

DETAILED DESCRIPTION OF THE PREFERRED EMBODIMENT

Figure 1:
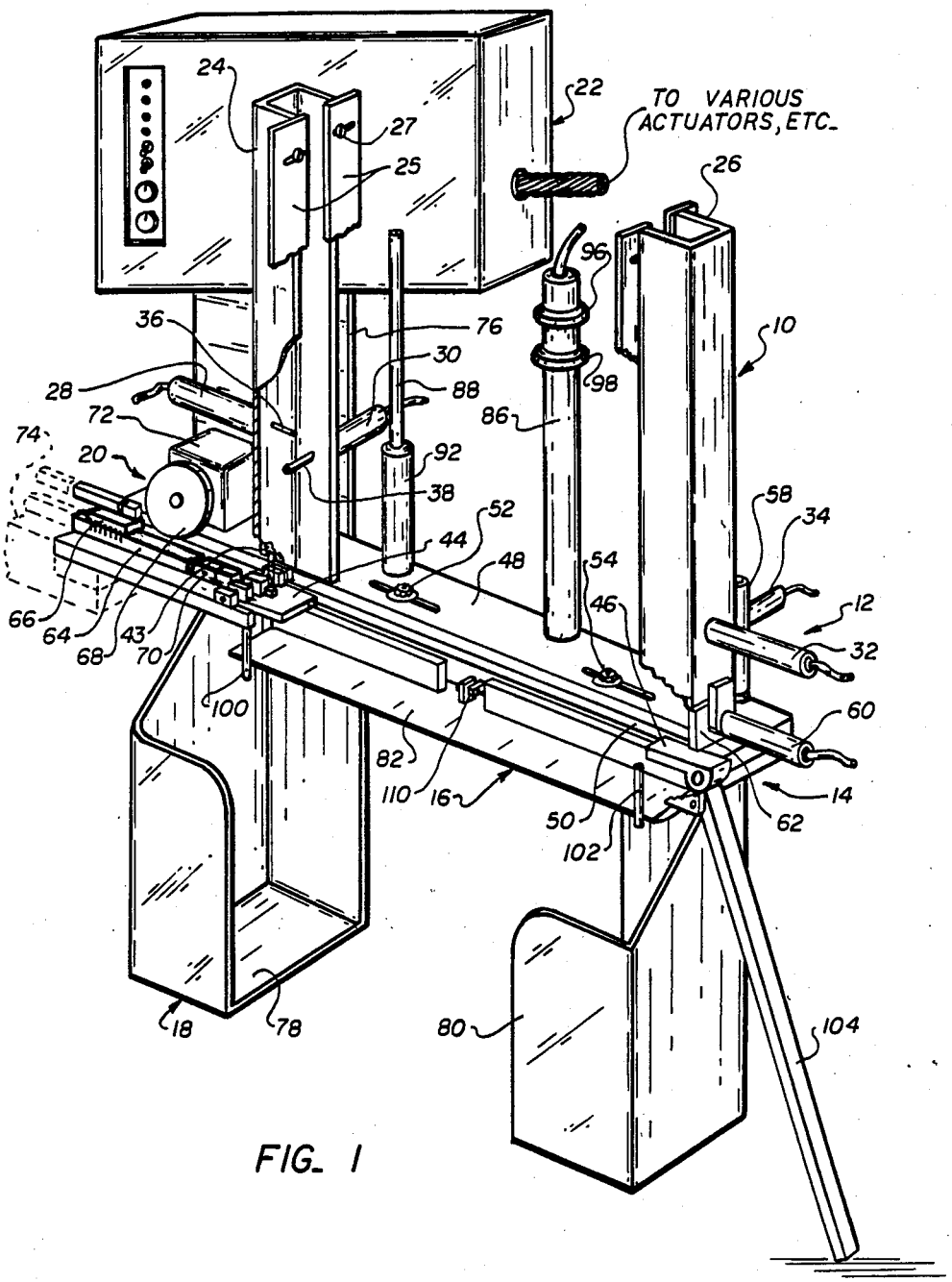
FIG. 1 is a partially broken perspective view showing a DIP tube loader and handler apparatus in accordance with the present invention.

Referring now to FIG. 1 of the drawing, a DIP tube handler and loading apparatus in accordance with the present invention is illustrated and includes a magazine 10 for receiving a plurality of empty DIP tubes, a tube singulator assembly shown generally at 12, means forming a tube loading station shown generally at 14, a tube carrying elevator 16, an output hopper 18, a DIP singulating and counting mechanism 20, and an electronics and pneumatics control console 22.

The input magazine 10 is essentially comprised of a pair of spaced apart channel-like members 24 and 26 that are generally C-shaped in cross section. The members 24 and 26 are spaced apart a predetermined distance and have their open sides facing each other to form a slot for receiving a plurality of empty DIP tubes which are loaded in from the top, as will be further described below. The transverse width of the openings in members 24 and 26 is adjustable and normally selected to be slightly larger than the maximum outside width of the tubes to be handled, and the spacing between the two members is slightly greater than the lengths of the DIP tubes. Adjustability of the width of the members 24 and 26 is accomodated by plates partially shown at 25. The plates 25 are slotted so that by loosening the attachment screws 27 they can be positioned nearer or farther apart as required.

Positioned at different elevations along the respective members 24 and 26 are four pneumatic actuators 28, 30, 32 and 34 having retractable stop pins 36 and 38 extending through member 24, and similar pins 40 and 42 (see FIG. 2) extending through the walls of member 26. As will be further described below, the pins 38–42 are actuated in such a manner as to drop one tube at a time (under control of the control console 22) onto the loading station 14.

Figure 2:
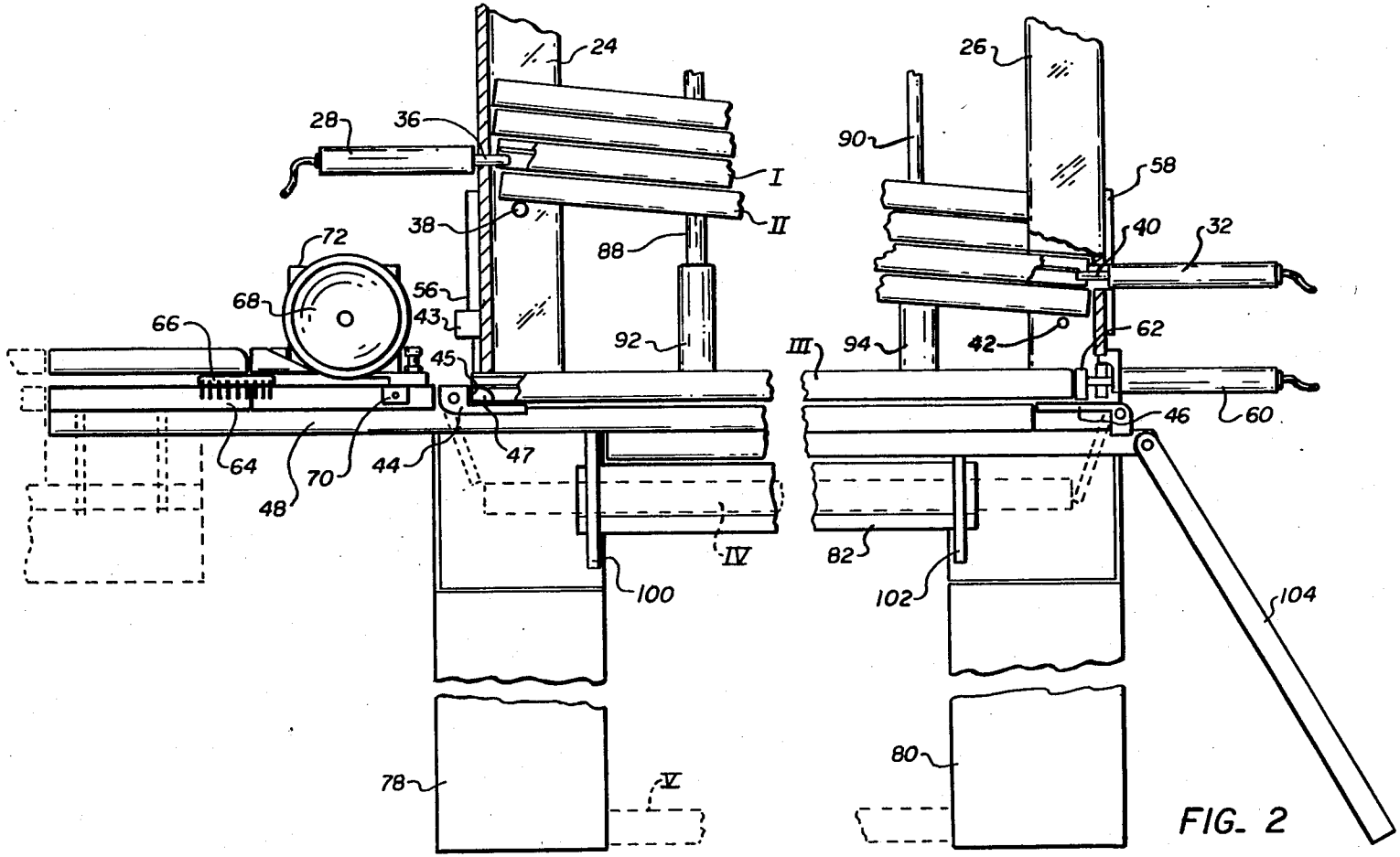
FIG. 2 is a partially broken front elevation thereof.

Loading station 14 is comprised of a pair of tube end support members 44 and 46 which are respectively pivotly attached to plates 48 and 50 that are attached to each other by means of bolts 52 and 54, and form a base for the apparatus. As will be further described below, the member 44 is rotatable between the horizontal position illustrated and a vertical position by means of a pneumatic actuator 56 (FIG. 2). Member 46 is similarly rotatable by a pneumatic actuator 58. Member 24 is attached to plate 48, while member 26 is attached to plate 50. Accordingly, by loosening the bolts 52 and 54, the plates can be slipped laterally relative to each other to carry members 24 and 26 into a different spacing to accommodate tubes of different length.

Also secured to member 26 is a pneumatic actuator 60 which drives a tube and engaging a plate 62. The purpose of actuator 60 is to drive a tube leftwardly onto member 44 where its position is sensed by a microswitch 43.

Attached to the top of the left side of plate 48 is a rail 64 along which DIPs 66 may slide past a singulator wheel 68 and counting photodiode 70. The singulator wheel 68 is affixed to the shaft of a drive motor 72 that is pivotally attached to plate 48 so as to allow the wheel to ride up over the top of a DIP passing thereunder.

In use, the illustrated apparatus is normally attached to the output end of a DIP testing or lead trimming apparatus in the manner generally illustrated at 74. The control module 22 is attached to plate 48 by means of a suitable standoff bracket 76 or other means.

Figure 3:
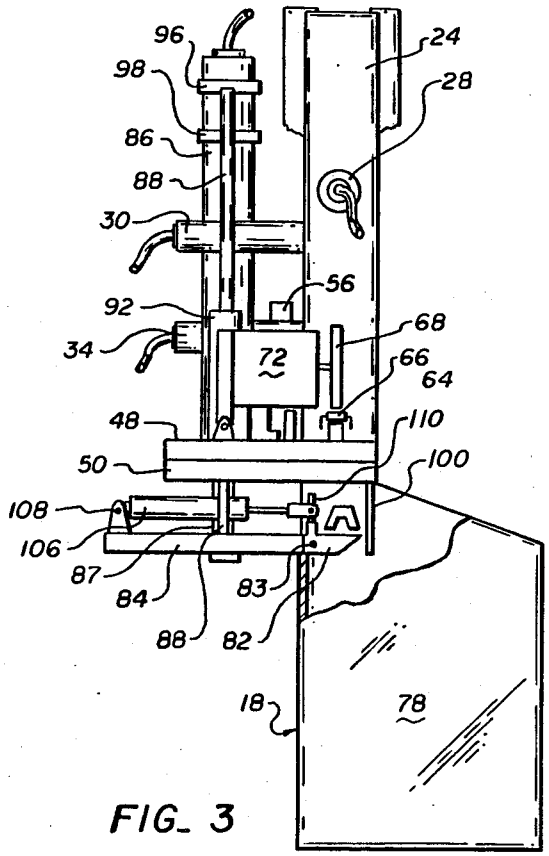
FIG. 3 is a partially broken left side elevation thereof.

A pair of formed sheet metal brackets 78 and 80 are attached to the bottom of plate 50 and together form an output hopper, or bin, 18 for receiving the DIP tubes after they are loaded. In order to gently lower the loaded tubes into bin 18, an elevator mechanism 16 is provided and includes a tube carriage 82 pivotly attached to a platform 84 (FIG. 3). The platform 84 is movable up and down relative to plates 48 and 50 by means of an actuator 86, and is maintained parallel to the plates by a pair of guide rods 88 and 90 (FIG. 2) which slide through a pair of ball bushings 92 and 94 attached to the top surface of plate 48. Actuator 86 is provided with a pair of sensors 96 and 98 which report the position of the elevator to the control console 22.

In order to ensure that a loaded tube does not fall off of the supporting surface of carriage 82 as it is lowered thereunto, a pair of downwardly extending pins 100 and 102 are affixed to the bottom of plate 50 to provide additional support for the apparatus. A support leg 104 is also pivotly attached to plate 50.

Figure 4:
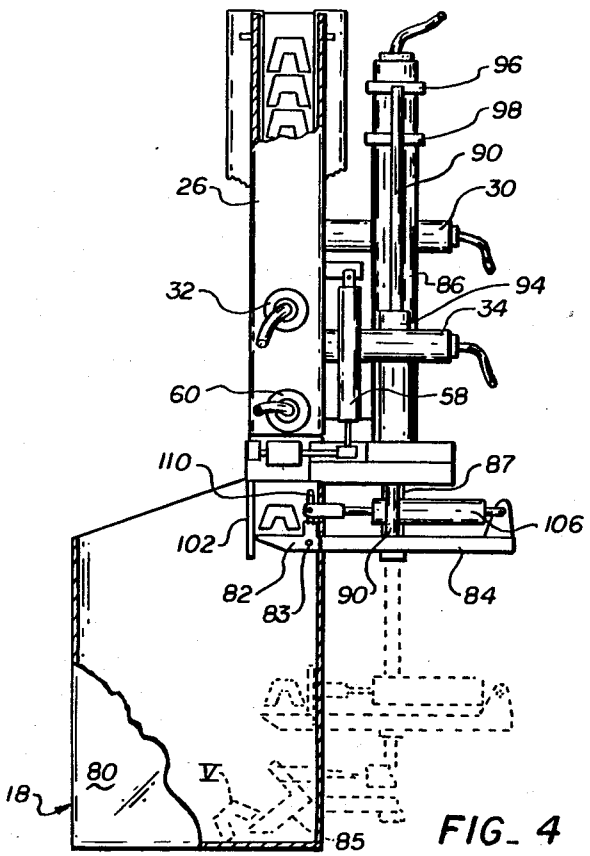
FIG. 4 is a partially broken right side elevation thereof.

Turning now to FIGS. 2 through 4, the elevator mechanism 16 will be further described. Although normally mounted in the inclined position shown in FIG. 1, for convenience FIGS. 2-4 show the device in a non-inclined disposition. As is particularly shown in FIGS. 3 and 4, the platform 84 is attached to the shafts 88 and 90 as well as the drive rod 87 of actuator 86. Carried by plate 84 is an elevator tilting actuator 106 which is pivotally connected thereto at 108. The drive arm of actuator 106 is pivotally connected to a lever arm 110 (see also FIG. 1), and serves to maintain the platform 82 horizontal until actuator 106 is activated to rotate the platform forward to discharge a carried DIP.

As illustrated in FIG. 2, a plurality of empty tubes placed in the magazine formed by members 24 and 26 will first be stopped with the lowermost tube in a first position II by engagement with pins 38 and 42, which are normally extended upon the start of each cycle, pins 36 and 40 are extended to engage the second tube and hold it in position I. Pins 36 and 40 are, prior to the start of each cycle, normally retracted.

At this point actuators 30 and 34 (FIG. 1) can be energized to retract pins 38 and 42, and allow the tube in position II to fall into a position lying on the upper surfaces of members 44 and 46. Note that pin 40 is positioned lower than pin 36 so that when each tube drops into the loading station, the rightmost end will hit first and any tendency to bounce will be absorbed by engagement with the end wall of member 26.

Thereafter, actuator 60 is energized, causing plate 62 to engage the right-most end of the carried tube and drive it leftwardly to engage a stop 45 formed in member 44. At the same time, the tube end engages a sense arm 41 of a microswitch 43 which serves to notify console 22 that a tube is ready to be loaded. As may be noted in FIG. 1, member 44 is configured so that a central portion thereof forms a continuation of track 64. Extending rightfully therefrom is a guide plug 47 which is engaged by the notched underside of the tube and aligns it properly with the input rail. The tube is now in position III and is ready to receive DIPs.

At this time, singulator wheel 68 is rotated by motor 72 to allow a predetermined number of DIPs 66 to pass thereunder and into the tube. The number of DIPs actually passing into the tube at positioned III is counted by a counter which responds to the output of photodetector 70. When the desired number of DIPs have been loaded, motor 72 is de-energized to terminate the flow of dips along rail 64.

The pneumatic actuators 56 and 58 are then energized and cause the members 44 and 46 to tilt downwardly and allow the loaded tube to move into position IV and be supported therein by the elevator 82. Actuator 86 is then energized to lower the tube into the bottom of the hopper 18. Pressure sensitive means (not shown), are provided for sensing the engagement of platform 82 with either the bottom of hopper 18, or the upper layer of tubes lying therein, and immediately terminate the activation of actuator 86 allowing it to return platform 82 to its upper position. However, as soon as platform 82 terminates its downward motion, actuator 106 is energized causing platform 82 to tilt forward, as indicated at 85 in FIG. 4, thereby allowing the tube to slide off into hopper 18. Actuator 106 is then caused to return platform to its horizontal position where it is ready to receive another loaded tube.

Figure 5:
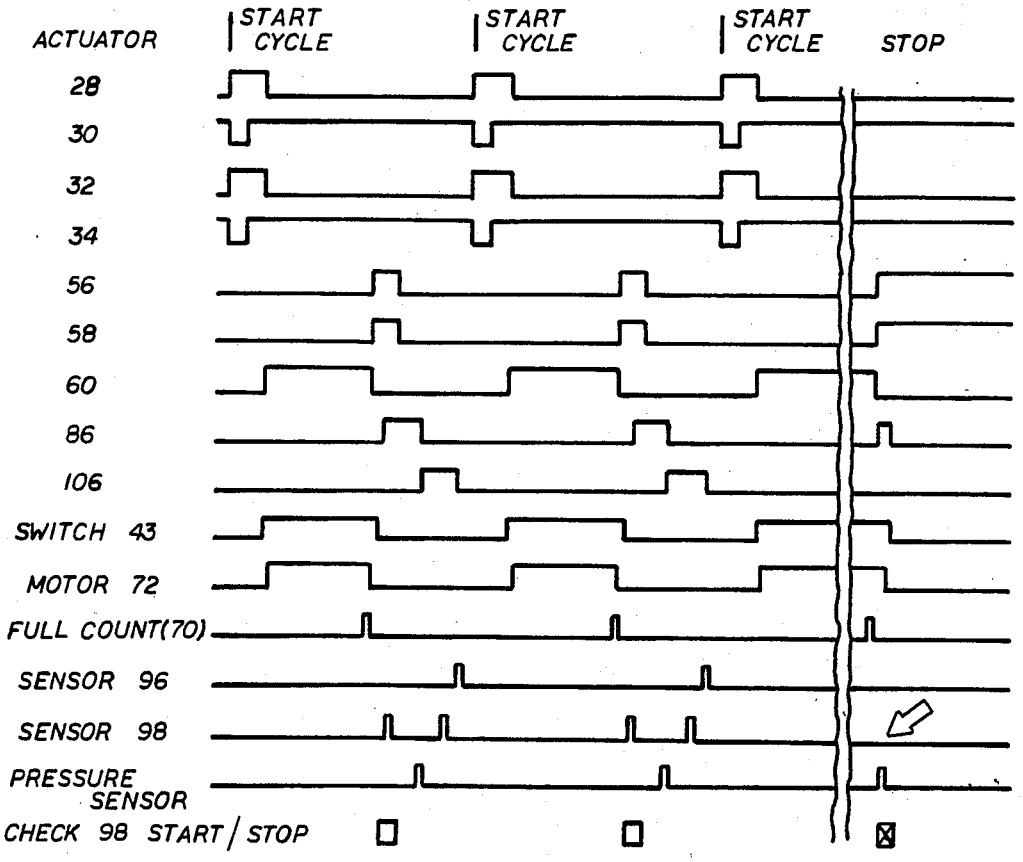
FIG. 5 is a timing diagram illustrating the sequence of operation thereof.

The complete operational sequence is illustrated in FIG. 5 and is basically as follows:

After a full load of tubes is positioned within magazine 10, with pins 36 and 40 retracted and pins 38 and 42 extended, the operator starts the cycle by pressing a start button on console 22. This causes actuators 30 and 34 to retract pins 38 and 42 allowing the first tube to drop onto the members 44 and 46. The following tube is retained in position by pins 36 and 40. Following a short delay of approximately one second, actuator 60 is energized and causes plate 62 to engage the end of the tube and push it leftwardly into engagement with member 44. At the same time, the left-most end of the tube engages and closes limit switch 43 which indicates to the controller that the tube is ready to be loaded.

Motor 72 is then energized to rotate wheel 68 and allow DIPs 66 to be loaded into the tube. As each DIP passes the photodetector 68, the controller performs a count, and following a full count indication, de-energizes motor 72 to stop the loading operation. At such time, the tube load actuator 60 is retracted, and actuators 56 and 58 are extended causing the support members 44 and 46 to be rotated into their vertical position allowing the loaded tube to drop onto platform 82.

Following a one second delay, actuators 28 and 32 will be retracted to allow the next tube to move into position II against pins 38 and 40 (FIG. 2). Elevator actuator 86 is then activated to lower elevator 16 until it either reaches the end of its stroke or engages the top of a stack of tubes. In either event, as soon, as the pressure in cylinder 86 builds up to a predetermined level, a pressure switch will be actuated allowing elevator 16 to begin its return upwardly. During this period, actuator 106 will be extended to rotate platform 82 downwardly and allow the carried tube to slide into hopper 18.

The elevator will then return to its upper position, and upon reaching the top, as sensed by sensor 96 will cause a new cycle to commence. Tubes in the magazine 10 will then be continuously loaded and lowered into hopper 18 until such time as the elevator will not extend low enough to trip sensor 98 before the pressure sensor is actuated. Upon such occurrence, operation of the apparatus will be terminated. However, until such occurrence empty tubes may be continuously off-loaded by an operator without interfering in any way with operation of the device.

Although the electrical wiring and pneumatic actuators is not shown in detail, it is believed that such detail is well within the skill in the art.

It will of course be appreciated that the above-described embodiment is but one way in which to present invention can be configured. Furthermore, it is contemplated that numerous alterations and modifications thereof will become apparent to those skilled in the art after having used the above-description. For example, whereas in the illustrated embodiment the DIPs, or "bugs" as they are sometimes referred to, are transported in the "fast down" or "live bug" configuration. It is to be understood that the device could just as well be configured to handle the tubes and bugs in the "dead bug" or "feet up" position.

What is claimed is:

1. An improved DIP handler and loading apparatus, comprising:

magazine means adapted to contain a plurality of DIP tubes oriented in a predetermined manner, said magazine means including a pair of spaced apart channel shaped members forming an upwardly directed passageway into which a plurality of DIP tubes may be positioned and through which said tubes may pass under the influence of gravity;

means forming a tube loading station having an input track means and singulating means for admitting a predetermined number of DIPs to said loading station;

tube singulation means associated with said magazine means and operative to present one tube at a time to said loading station;

tube positioning means associated with said loading station and operative to position a tube into DIP receiving engagement with said input track means;

output bin means for receiving tubes loaded with DIPs; and elevator means adapted to receive tubes loaded with DIPs at said loading station and to transport said loaded tubes to said output bin means.

2. An improved DIP handler and loading apparatus as recited in claim 1, wherein said elevator means includes means forming a platform for receiving a loaded DIP tube, and means for moving said platform between a tube receiving position proximate said loading station and a tube discharge position within said output bin means.

3. An improved DIP handler and loading apparatus as recited in claim 2, wherein said elevator means includes a tube discharging means for dislodging a carried tube from said platform after it is lowered into said output bin means.

4. An improved DIP handler and loading apparatus as recited in claim 3, wherein said elevator means includes means for sensing engagement of said platform with loaded tubes contained in said output bin means and for limiting the lowering of said platform beyond such engagement.

5. An improved DIP handler and loading apparatus, comprising:

magazine means adapted to contain a plurality of DIP tubes oriented in a predetermined manner;

means forming a tube loading station having an input track means and singulating means for admitting a predetermined number of DIPs to said loading station;

tube singulation means associated with said magazine means and operative to present one tube at a time to said loading station, said tube singulation means including a plurality of pneumatic actuators having extendable and retractable stop pins extending through openings formed in said channel shaped members to alternately engage and disengage the ends of the lower most tube contained in said magazine means;

tube positioning means associated with said loading station and operative to position a tube into DIP receiving engagement with said input track means;

output bin means for receiving tubes loaded with DIPs; and elevator means adapted to receive tubes loaded with DIPs at said loading station and to transport said loaded tubes to said output bin means.

6. An improved DIP handler and loading apparatus as recited in claim 5, wherein said means forming a tube loading station includes a tube alignment and support means which cooperates with said tube positioning means to align one end of a tube with said input track means.

7. An improved DIP handler and loading apparatus as recited in claim 6, wherein said alignment and support means is pivotable between a tube support position and a tube discharge position wherein a supported tube is allowed to fall under the influence of gravity onto said elevator means.

8. An improved DIP handler and loading apparatus as recited in claim 7, wherein said means forming a tube loading station further includes a support the tube end opposite that supported by said alignment and support means, said support number being pivotable between a tube support position and a tube discharge position wherein a supported tube is allowed to fall under the influence of gravity onto said elevator means.

9. An improved DIP handler and loading apparatus as recited in claim 8, wherein said elevator means includes means forming a platform for receiving a loaded DIP tube, and means for moving said platform between a tube receiving portions approximate said loading station and a tube discharge position within said output bin means.

10. An improved DIP handler and loading apparatus as recited in claim 9, wherein said elevator means includes a tube discharging means for dislodging a carried tube from said platform after it is lowered into said output bin means.

11. An improved DIP handler and loading apparatus as recited in claim 10, wherein said elevator means includes a means for sensing engagement of said platform with loaded tubes contained in said output bin means and for limiting the lowering of said platform beyond such engagement.

12. An improved DIP handler and loading apparatus, comprising:

magazine means adapted to contain a plurality of DIP tubes oriented in a predetermined manner;

means forming a tube loading station having an input track means and singulating means for admitting a predetermined number of DIPs to said loading station, said means forming a tube loading station including a tube alignment and support means which cooperates with said tube positioning means to align one end of a tube with said input track means, said alignment and support means being pivotable between a tube support position and a tube discharge position, wherein a supported tube is allowed to fall under the influence of gravity onto said elevator means;

tube singulation means associated with said magazine means and operative to present one tube at a time to said loading station;

tube positioning means associated with said loading station and operative to position a tube into DIP receiving engagement with said input track means;

output bin means for receiving tubes loaded with DIPs; and elevator means adapted to receive tubes loaded with DIPs at said loading station and to transport said loaded tubes to said output bin means.

13. An improved DIP handler and loading apparatus as recited in claim 12, wherein said means forming a tube loading station further includes a support member positioned to support the tube end opposite that aligned by said alignment and support means, said support member being pivotable between a tube support position and a tube discharge position wherein a supported tube is allowed to fall under the influence of gravity onto said elevator means.

14. An improved DIP handler and loading apparatus as recited in claim 13, wherein said elevator means includes means forming a platform for receiving a loaded DIP tube, and means for moving said platform between a tube receiving portions approximate said loading station and a tube discharge position within said output bin means.

15. An improved DIP handler and loading apparatus as recited in claim 14, wherein said elevator means includes a tube discharging means for dislodging a carried tube from said platform after it is lowered into said output bin means.

16. An improved DIP handler and loading apparatus as recited in claim 15, wherein said elevator means includes means for sensing engagement of said platform with loaded tubes contained in said output bin means and for limiting the lowering of said platform beyond such engagement.

* * * * *